US005363720A

United States Patent [19]

Sanchez

[11] Patent Number: 5,363,720

[45] Date of Patent: Nov. 15, 1994

[54] STOVE KNOB SAFETY CAP

[76] Inventor: Jesse Sanchez, 4222 W. Alamos, Ste. 109W, Fresno, Calif. 93711

[21] Appl. No.: 976,075

[22] Filed: Nov. 13, 1992

Related U.S. Application Data

[63] Continuation-in-part of Ser. No. 750,836, Aug. 27, 1991, abandoned.

[51] Int. Cl.[5] ..... G05G 1/10

[52] U.S. Cl. ..... 74/553; 74/558.5; 74/548; 200/333; 126/42; 16/118

[58] Field of Search ..... 74/553, 558.5, 548; 200/333, 334; 126/39, 42; 16/118, 121, 363, 343, 250, DIG. 3; 70/455, 207, 209

[56] References Cited

U.S. PATENT DOCUMENTS

| | | | |
|---|---|---|---|
| 2,501,008 | 3/1950 | Schramm | 74/548 |
| 3,019,667 | 2/1962 | Bann | 74/553 |
| 3,473,408 | 10/1969 | Bettinger | 74/553 |
| 3,529,584 | 9/1970 | Celaya | 126/42 |
| 4,298,778 | 11/1981 | Beresford-Jones | 200/333 |
| 4,575,141 | 3/1986 | Burns | 74/553 |
| 4,858,454 | 8/1989 | McAnulty, III | 70/455 |

FOREIGN PATENT DOCUMENTS

| | | | |
|---|---|---|---|
| 3637451 | 5/1988 | Germany | 74/553 |

*Primary Examiner*—Carl D. Friedman
*Assistant Examiner*—Winnie Yip
*Attorney, Agent, or Firm*—Townsend and Townsend Khourie and Crew

[57] ABSTRACT

A dome-shaped cap which fits over standard stove knobs to prevent small children and toddlers from turning or engaging the knobs. Two latches, one of each side of the cap, are simultaneously depressed to release or install the cap. The latches are attached to the underside of a skirt which extends around the bottom of the dome-shaped cap. Each latch is an L-shaped member which rotates around a pin extending from the skirt.

5 Claims, 3 Drawing Sheets

STOVE KNOB SAFETY CAP

This application is a continuation-in-part of application Ser. No. 07/750,836 filed Aug. 27, 1991 now abandoned.

BACKGROUND OF THE INVENTION

The present invention relates to a protective cap which can be placed over a stove knob to prevent toddlers or small children from turning on ovens, burners or opening gas lines on gas stoves.

One of the most dangerous areas for children in the home is the kitchen, especially the stove. Children observe their parents turning and operating stove knobs and waste no time in trying to do so themselves, despite parental vigilance. These dangers can be prevented by interrupting the rotation of the control knobs on the front of the stove or oven.

It is therefore a primary object of the present invention to provide a removable device that covers a stove knob to prevent children from engaging or turning the knob. It is a further object of the present invention to provide a removable device that covers a stove knob that is adjustable so as to fit the wide range of sizes of stove knobs available on the market today.

SUMMARY OF THE INVENTION

The present invention is principally comprised of a dome-shaped cap, designed to cover the handle of a typical stove knob. Extending around the bottom of the cap is a circular lip or "skirt" which covers the dial portion of the knob. The cap has two latches with springs, one on each side of the skirt. Each latch rotates around a bearing, build into the skirt of the invention. Such a cap may be installed or removed by simultaneously squeezing both latches. When released, the inside of the latches hook under the stove knob. Turning the cap while it is installed on the knob will only cause the cap to spin harmlessly over the top of the knob. A young child's hand does not have the necessary strength to release both latches.

DESCRIPTION OF SPECIFIC EMBODIMENTS

Figure 1:
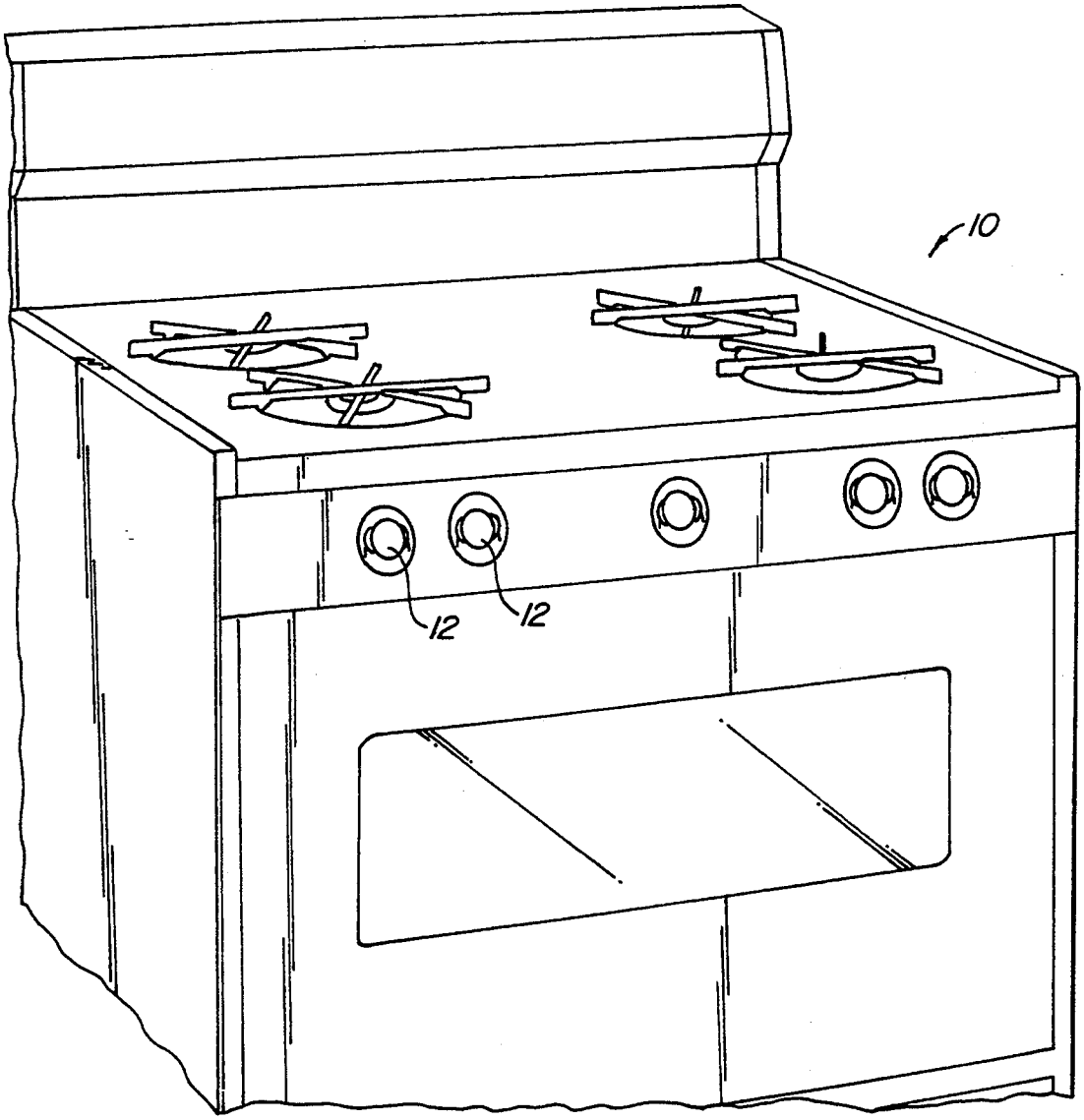
FIG. 1 is a perspective view of several of the safety caps of the present invention on a stove.
Figure 2:
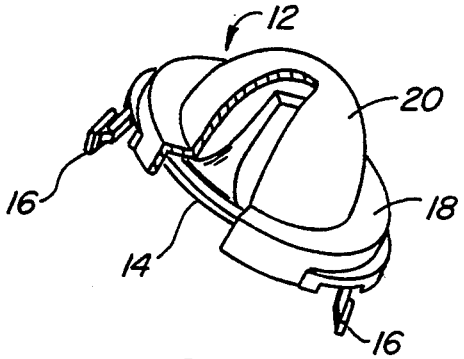
FIG. 2 is a partially cutaway view of a safety cap over a stove knob.

FIG. 1 shows a stove 10 with a number of caps 12 mounted over the stove knobs. FIG. 2 shows one of the caps 12 mounted over a stove knob 14, which is visible through a broken away portion of cap 12. A pair of latches 16 are mounted on the underside of a lip or skirt 18. Lip 18 is attached to a central dome 20 which covers the stove knob.

Figure 3:
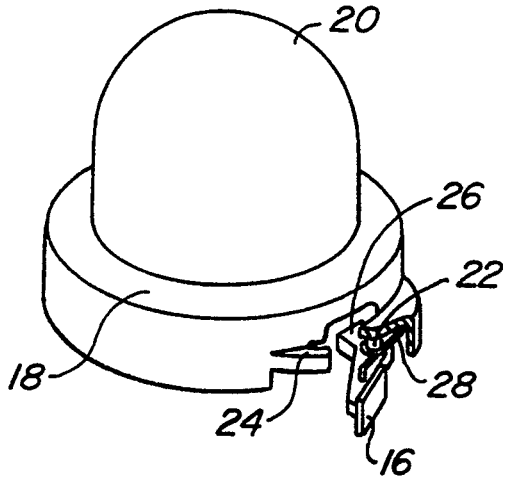
FIG. 3 is a perspective view of the cap of FIG. 2 showing the latch mechanism partially broken away.

As can be seen in the broken away view of FIG. 3, latch 16 rotates around a pin or bearing 22 which is attached to the underside of a shelf 24 which extends from lip 18. An inside end 26 of the latch is biased into a position where it will be under the stove knob by a spring 28.

Figure 4:
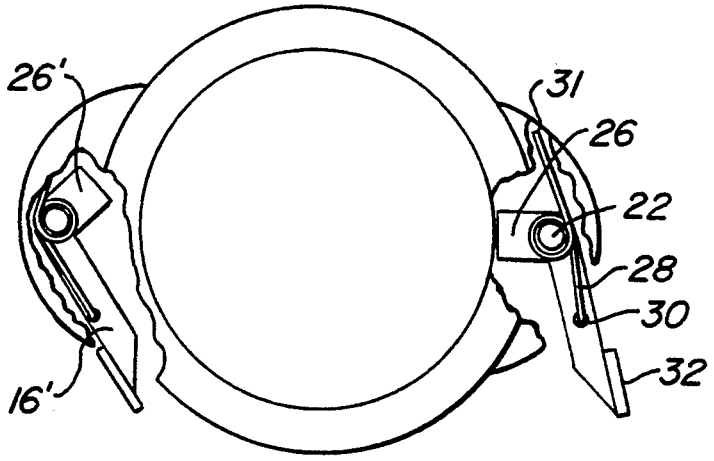
FIG. 4 is a top view of the cap of FIG. 3.

FIG. 4 shows a top view of the mechanism of FIG. 3, showing the placement of the spring in more detail. As can be seen, spring 28 is attached to the latch at a point 30, wraps around bearing 22 and has a far end 31 biased against the inside edge of shelf 24. In the biased position, the inside portion 26 of the latch is positioned to be under the stove knob 14 in a first position. In a second position shown by latch 16' on the left, the inside edge 26' is moved out from underneath the stove knob.

Figure 5:
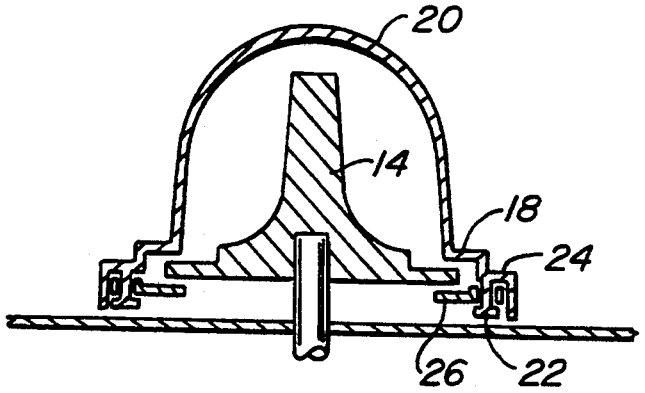
FIG. 5 is a side, cutaway view of the cap of the present invention over a stove knob.
Figure 6:
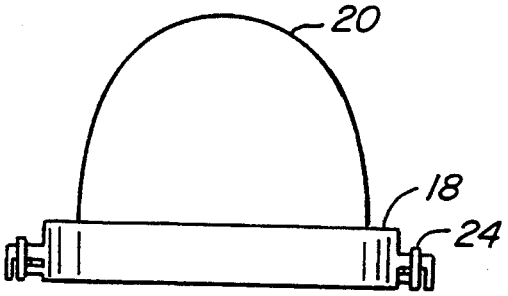
FIG. 6 is a side view of the cap of the present invention.

FIG. 5 shows the positioning of the inside edge 26 of the latch with respect to the stove knob 14 more clearly. As can be seen, in its relaxed position, inside edge 26 is underneath the edge of stove knob 14, and thus will hold the cap in place.

Returning to FIG. 4, it can be seen that latch 16 is L-shaped, with the inside edge 26 forming a short end of the L, with the other end of the L having at its far end a flat portion 32. Portion 32 is squeezed by a user inward, as is the portion 32 of the opposing latch, to force inside edge 26 out from underneath the stove knob 14 to allow removal or placement of the cap over the stove knob.

Figure 7:
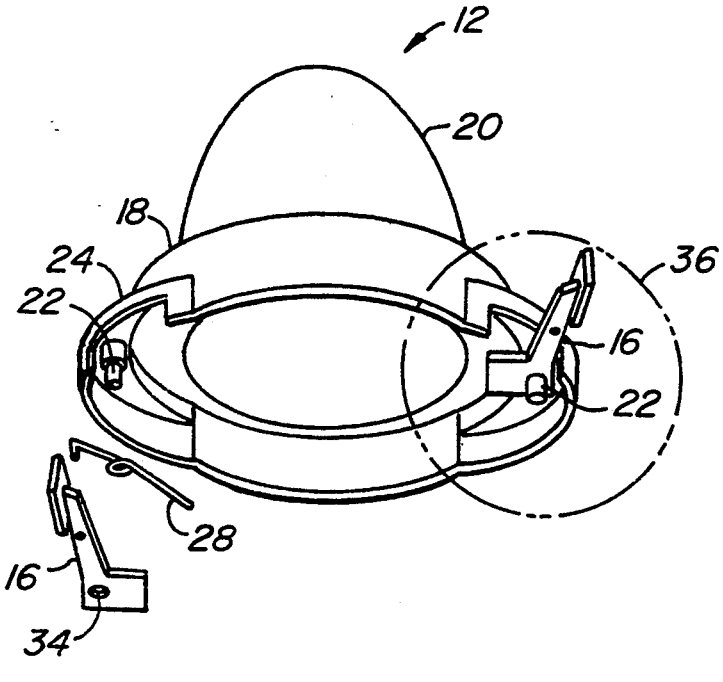
FIG. 7 is a perspective, exploded view showing the elements of the latch mechanism.
Figure 8:
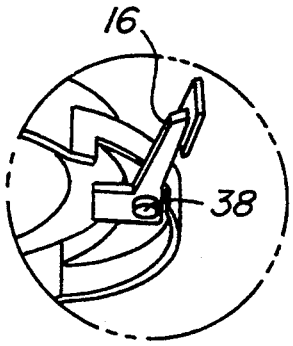
FIG. 8 is a perspective view of the latch mechanism after assembly.

FIG. 7 illustrates the construction of the cap of the present invention. FIG. 7 shows the underside view of cap 12 with pin or bearing 22 extending from the bottom of shelf 24. Upon assembly, spring 28 is placed around bearing 22, and then latch 16 has bearing 22 pressed through a hole 34. The left side of FIG. 7 shows the exploded view of the elements, with the right side within circle 36 showing the latch assembled, with the bearing 22 extending through hole 34 in latch 16. After assembly, the end of bearing 22 is "hot staked" by applying heat to deform the plastic to produce a nodule or keeper 38 as shown in FIG. 8. Nodule or keeper 38 at the end of bearing 22 will hold latch 16 in place.

What is claimed is:

1. A stove knob safety cap for placement over a stove knob on a stove to prevent turning of the stove knob, the safety cap comprising:

a dome-shaped cap with a hollow interior for fitting over said stove knob;

a circular skirt extending outwardly around and below the cap; and a pair of latches pivotally attached to the skirt on opposite sides of the skirt, each latch including a pin secured to an underside of the skirt and a pivoting member pivotally mounted around said pin, said pivoting member having an inside member for engaging between the stove knob and the stove in a first position, and being clear of the stove knob in a second position.

2. The stove knob safety cap of claim 1 further comprising a pair of shelves extending from the skirt on opposite sides of the skirt, each of said latches being attached to a bottom side, opposite said dome-shaped cap, of one of said shelves.

3. The stove knob safety cap of claim 1 wherein said pivoting member comprises an L-shaped member mounted around said pin.

4. The stove knob safety cap of claim 3 further comprising a spring for biasing said inside member of each of said latches to said first position.

5. The stove knob safety cap of claim 4 wherein said cap, skirt and pin are made of plastic, and further comprising a nodule on an end of said pin to hold said L-shaped member in place.

* * * * *